US005418979A

United States Patent [19]

Senderowicz

[11] Patent Number: 5,418,979

[45] Date of Patent: May 30, 1995

[54] ZIPPERLESS, SNAPLESS, LACELESS INFANT SAC WITH CAR SAFETY SEATING CAPABILITY

[76] Inventor: Khoi N. Senderowicz, Berkeley Main 2000 Allston Way, Berkeley, Calif. 94704

[21] Appl. No.: 88,919

[22] Filed: Jul. 7, 1993

[51] Int. Cl.[6] ..... A41D 11/00

[52] U.S. Cl. ..... 2/75; 2/80; 2/69

[58] Field of Search ..... 2/75, 80, 79, 69, 70, 2/114, DIG. 7, DIG. 2, 69.5, 912, 913, 914, 915

[56] References Cited

U.S. PATENT DOCUMENTS 782,819 2/1905 Bikle ..... 2/75
2,723,398 11/1955 Tuteur ..... 2/80
4,897,885 2/1990 Lunt ..... 2/75
4,901,371 2/1990 Christians ..... 2/80

*Primary Examiner*—Clifford D. Crowder
*Assistant Examiner*—Gloria Hale

[57] ABSTRACT

An infant sac which completely, consistently, and conveniently wraps the infant's body, leaving no undesirable exposed areas such as feet, hands and collar area. The sac is comprised of loose fitting sleeves with optional mitts (10), and two broad overlapping front panels. These panels are opened and closed through the use of some form of attachment such as hook and loop fastener fasteners at two given opposite points (20, 22). No zippers, snaps nor laces are required, essentially rendering the garment free of any potential sources of discomfort and/or injury to the infant. Furthermore, the design provides for optional separate leg compartments (24) for use with infant car seats, heretofore not possible with infant sacs.

1 Claim, 6 Drawing Sheets

6

ZIPPERLESS, SNAPLESS, LACELESS INFANT SAC WITH CAR SAFETY SEATING CAPABILITY

BACKGROUND - FIELD OF INVENTION

This invention relates to infant garments, specifically those referred to as "sacs" which attempt to cover the entire body comfortably.

BACKGROUND - DESCRIPTION OF PRIOR ART

Many types of shirts and outfits have been created to accommodate the special needs of infants, particularly newborns. FIGS. 1 and 2 show two types of long sleeved undershirts having mitts for the hands. (The extra half cuffs (10) sewn into the sleeve ends are inverted to make the mitts.) While this type of optional connected mitt is desirable and convenient, because the shirts themselves are snug fitting, the corresponding mitts for them tend to be too tight fitting thereby cramping the hands. Also the collar for these shirts tend to be cut low, leaving much exposed area. In the first instance this is because the collar has to accommodate for the pulling of the shirt over the head, while in the second case the small area and design needs thereof do not allow for otherwise.

The shirt of FIG. 1 requires pulling the shirt over the infant's head and then slipping the infant's arms into the tight sleeves. The shirt of FIG. 2 requires slipping the infant's arms into the snug fitting sleeves and then slipping the lace of the bottommost panel through the corresponding hole of the upper front panel and then tying the two laces together behind the infant's back. Thus, both types of shirts are quite cumbersome to put on, requiring a considerable amount of maneuvering to get them on the infant. Furthermore, because they leave the remaining portion of the body exposed, they also require additional covering.

It is common practice in hospitals to wear on the newborn a diaper and undershirt such as described above, and then to further cover or wrap the infant in a blanket (FIG. 3). This wrapping or swaddling provides for cozy covering which infants seem to need and enjoy. However, provided that the blanket were of appropriate dimensions and large enough, and the wrapper sufficiently skilled to make a thorough wrapping/swaddling, this method of covering still suffers from the problem that it is only very temporary. That is, it only lasts while the infant is relatively motionless, otherwise it falls apart.

FIG. 4A shows an infant "sac" which is basically an extended version of the pull-over type infant undershirt. It has a loop closure (16) which is tightened and tied at the bottom. While in principle this sac provides for more covering than just the undershirts by themselves, actually it is very common for the feet and legs of the infant to slip out of the opening at the bottom. Furthermore, besides being inconvenient to put on (requiring being pulled over the baby's head, etc.), it is also quite constricting because of the drastic tapering imposed by the closure (see FIG. 4B). This tapering also precludes the possibility of separating the legs for safety car seating. As many new parents are surprised to discover, in the case of the sac as well as the blanket swaddling, it is not possible to properly fasten the seat belts for the infant in the regulation car seats because of the "Y" shaped configuration of the seat belts. For this, some sort of leg compartment separation is required.

FIG. 5 shows a one piece outfit with footed leg compartments. While these are suitable for use with infant car seats, they require the use of either zippers, snaps or buttons for opening and closing. These are potential sources of discomfort if not injury (accidental "snagging" of skin, etc.), particularly in newborns who are quite fragile and spend the majority of their time sleeping on their stomachs. Moreover, in the case of zippers which provide more thorough closure than snaps, the protruding head of the zipper (18)—not to mention the flipping handle which could also poke the baby—rests at the delicate collar area. Since babies have short necks and wobbling heads in general, this represents a considerable source of discomfort. Also, this type of one piece outfit, because it is cut to fit snugly the entire body, is further limited in that it is quickly outgrown. No design heretofore known has effectively combined the elements to create an infant garment which is extremely functional, comfortable, durable and convenient to use.

OBJECTS AND ADVANTAGES

Accordingly, beside the above mentioned objects and advantages of infant garments such as to provide coveting to the hands, feet and whole body in as much as possible, more objects and advantages of this invention are:

(a) to provide an infant garment which provides coveting which is complete, constant and comfortable;

(b) to provide an infant garment which is extremely safe and convenient to use;

(c) to provide an infant garment which can also be used for seating in infant safety car seats;

(d) to provide an infant garment whose production is extremely convenient, rapid and economical;

(e) to provide an infant garment which will fit the infant for periods of at least six months.

Further objects and advantages will become apparent from a consideration of the ensuing description and drawings.

DRAWINGS FIGURES

REFERENCE NUMERALS IN DRAWINGS

10: optional mitts

12: laces for tying

14: slit for sliding lace through
16: lace for closure
18: zipper
20: hook and loop fastener tabs (opposite corners)
22: hook and loop fastener tabs (opposite corners)
24: hook and loop fastener tabs for separation

DESCRIPTION - FIGS 1 TO 9

Figure 1:
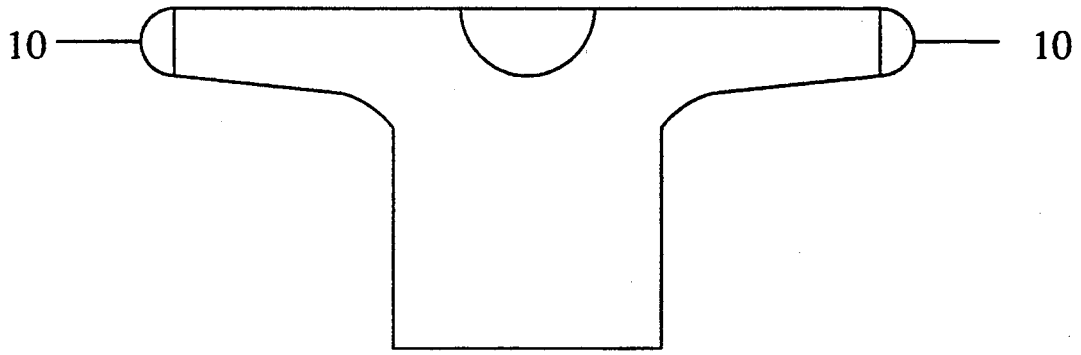
FIG. 1 shows a pull-over type infant undershirt with optional mitts.
Figure 2:
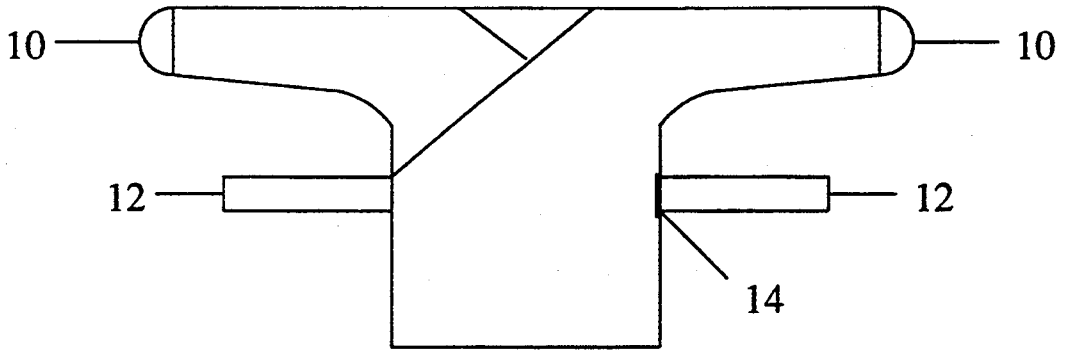
FIG. 2 shows a wrap around type infant undershirt with optional mitts.
Figure 3:
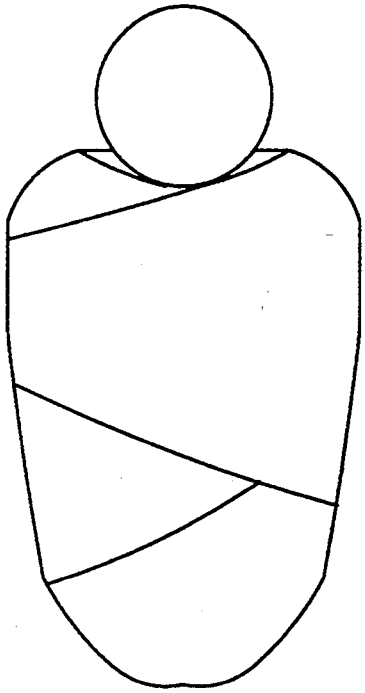
FIG. 3 shows an infant swaddling.
Figure 4A:
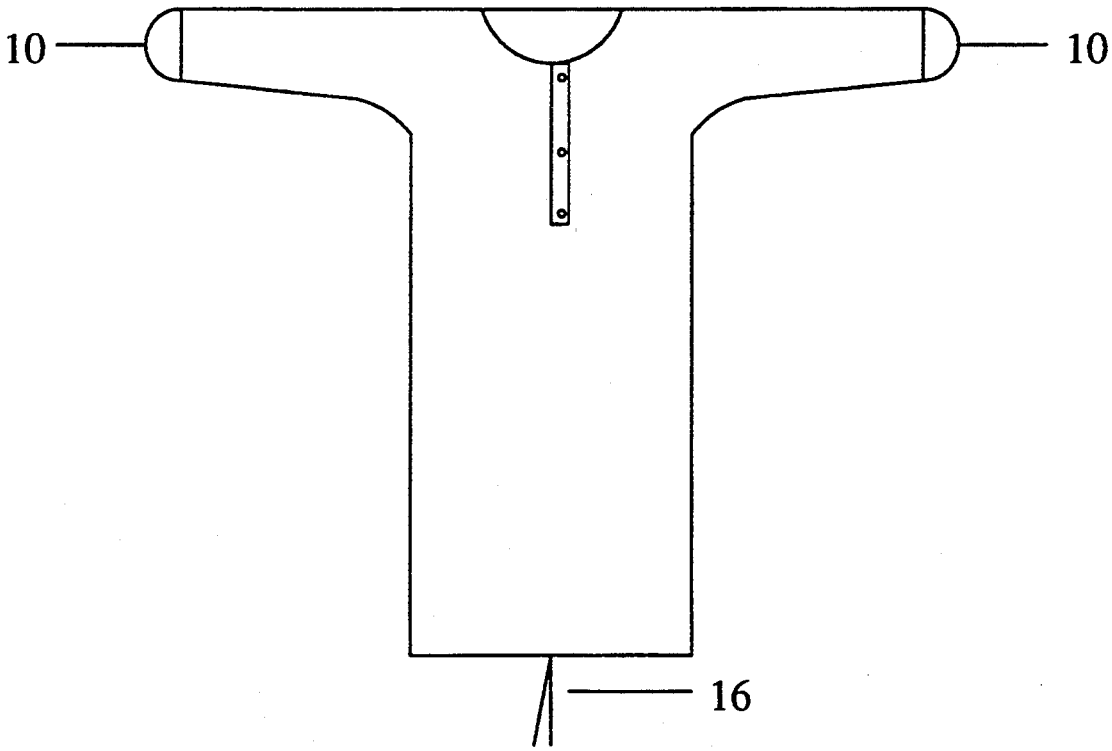
FIG. 4A shows an infant sac with a lace for tightening at the bottom.
Figure 4B:
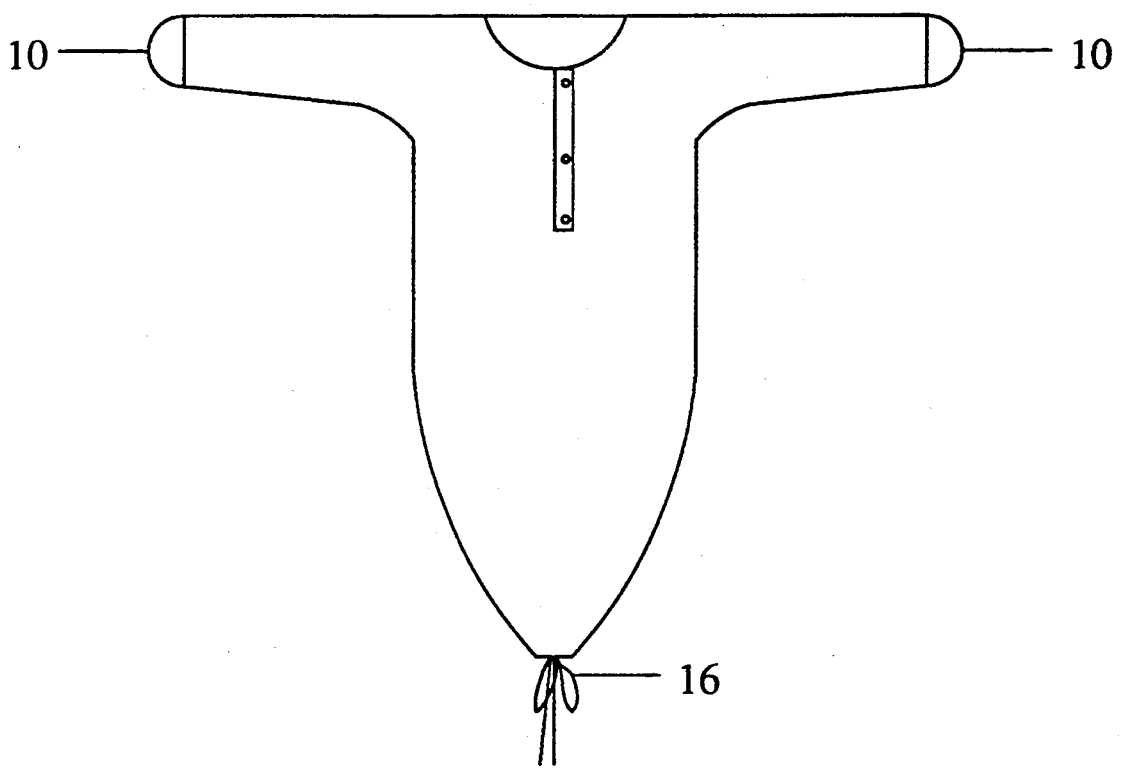
FIG. 4B shows the sac when it is closed at the bottom.
Figure 5:
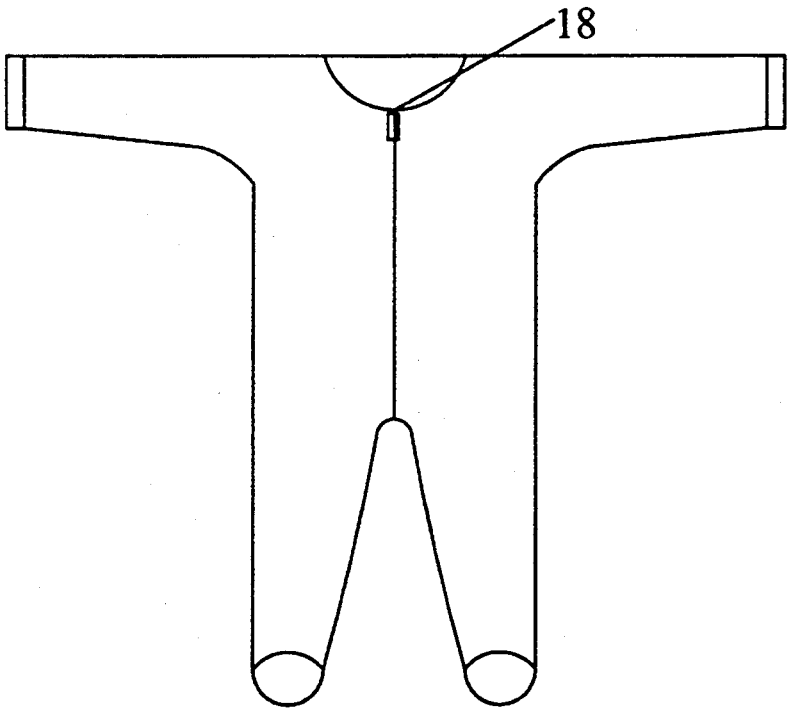
FIG. 5 shows a one piece outfit with separate leg compartments and feet covering.
Figure 6A:
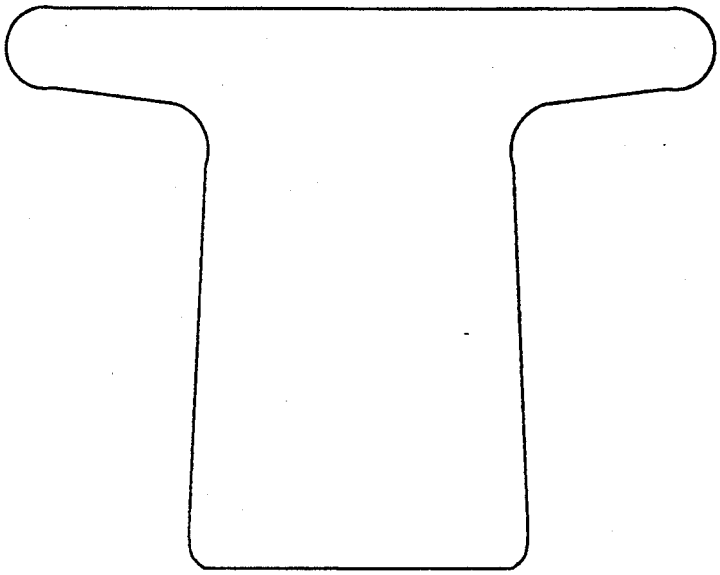
FIG. 6A shows the back piece.
Figure 6B:
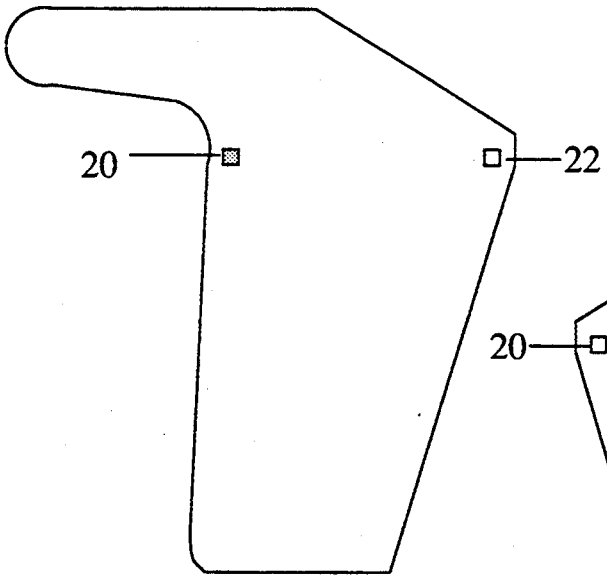
FIG. 6B shows the underside of the left panel with the appropriate hook and loop fastener tabs.
Figure 6C:
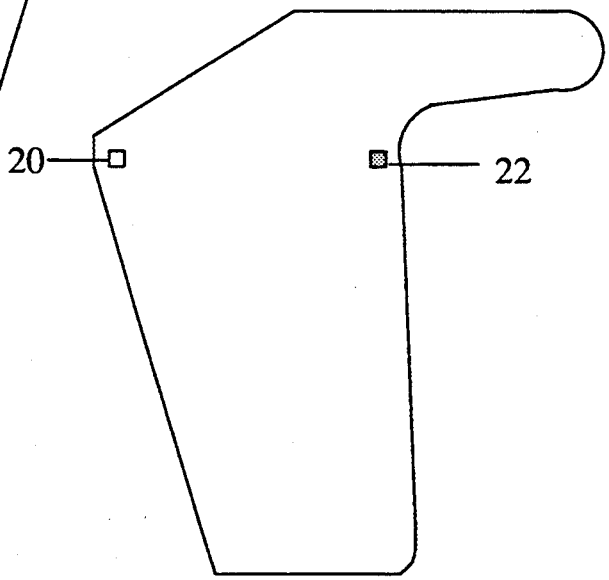
FIG. 6C shows the underside of the right panel with the appropriate hook and loop fastener tabs.
Figure 6D:
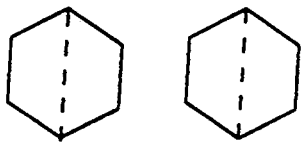
FIG. 6D shows the mitt pieces.
Figure 6E:
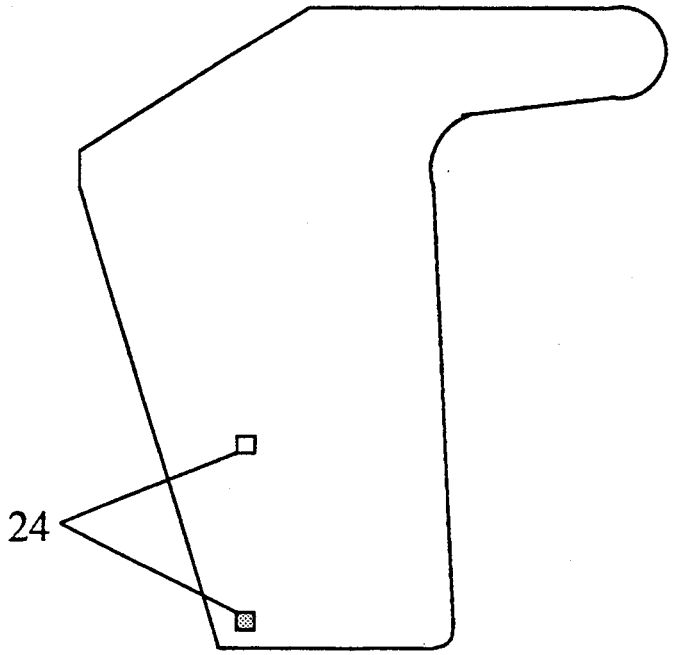
FIG. 6E shows the right panel right side up with the hook and loop fastener tabs for leg separation.
Figure 7:
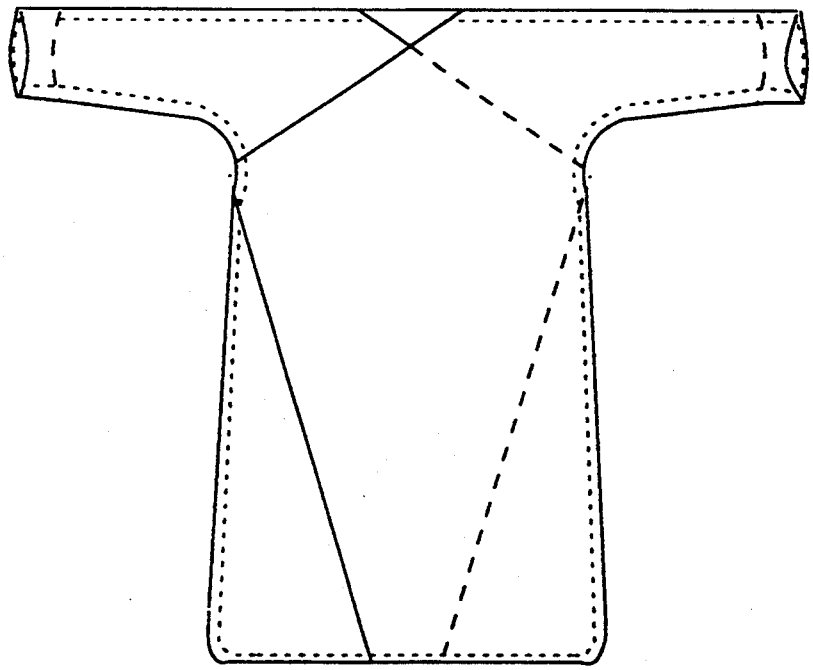
FIG. 7 shows all the pieces placed atop the back piece and sewn together at the seams.
Figure 8:
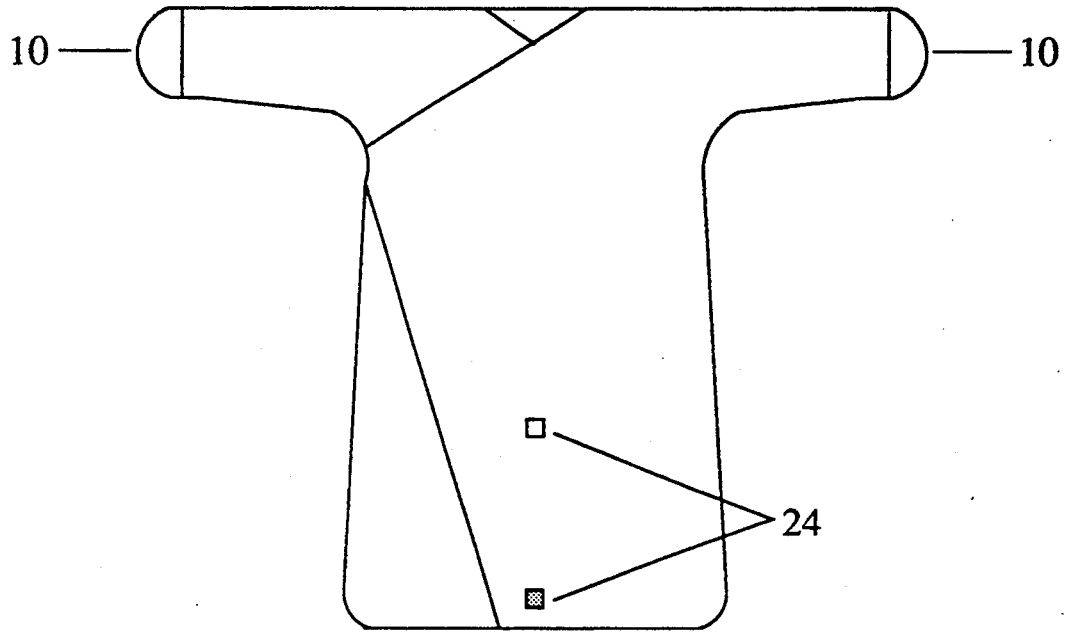
FIG. 8 shows the finished sac.
Figure 9:
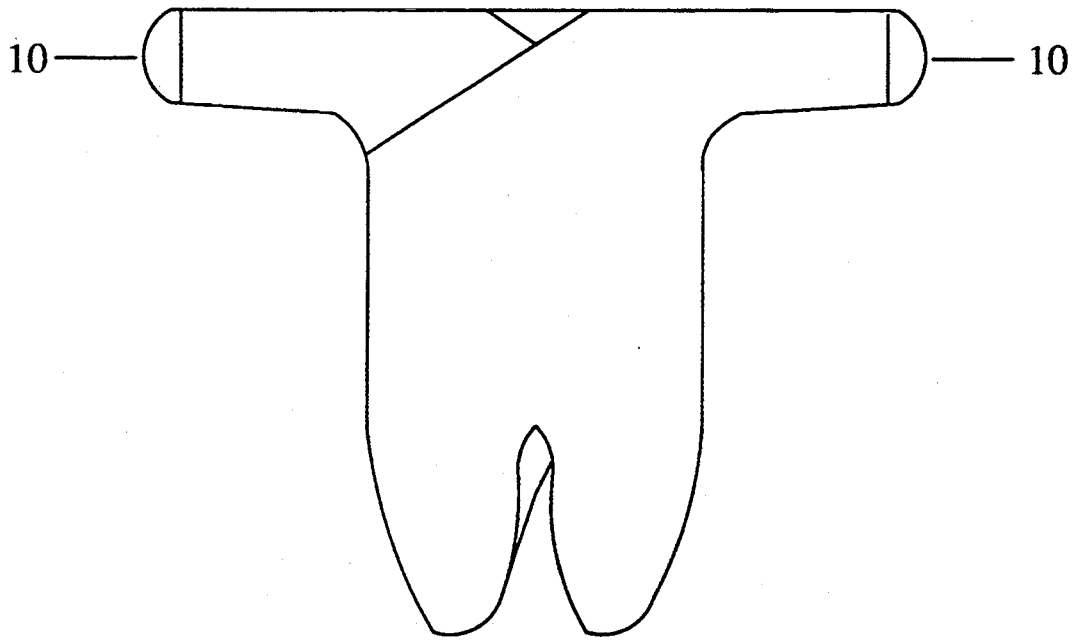
FIG. 9 shows the separate leg compartments.

The construction of a typical embodiment of the infant sac of my design is illustrated in FIGS. 6A to 7. In the preferred embodiment, the entire garment is made of 100% pure cotton. The suppleness of the material as well as the ampleness of the design allows for the separating leg compartments feature as shown in FIG. 9.

FIGS. 6A to 8 show the steps to making the garment. First the back piece is cut which consists of a one piece T-shaped portion including left and right sleeve portions and a body portion having left, right and bottom edges (FIG. 6). Then two identical mitt pieces conforming to the shape and size of the sleeve ends (FIG. 6D) are cut as well as two identical front panels (FIGS. 6B and 6C). Basically, the structure of the front panels is as follows: each panel conforms in shape and size to half (lengthwise) of the back piece, and further extends over the center to form the part of the panel which is left loose to open and close by means of a fastening device. The shape of the extended portions in the panels can be obtained by using four points with respect to an imaginary vertical line down the center of the back piece. Looking at the front of the garment, the first point for forming the extension of the left panel would be about one to two inches to the left of the center top. (This forms the collar opening.) From this collar point, a diagonal cut is made to the point where the right armpit section is. Here a vertical cut of about an inch can be made to allow for the fastening element. From this last point, another diagonal cut is made down to a point about two inches to the right of the center bottom. The same configuration is used for the right panel. Along the edges where the diagonal cuts occur, three-thread overlock stitching is applied to maximize durability and also yield a nice looking finished edge.

FIGS. 6B and 6C also show the hook and loop fastener tabs sewn into place at the opposite corners just below the armpit sections. FIG. 6E shows the hook and loop fastener tabs for the leg separating feature sewn onto the front right side out side of the right panel. The mitt pieces are folded in half, then all the pieces are aligned on top of the back piece in the following order (FIG. 7):

(1) Folded mitt pieces;
(2) Left panel;
(3) Right panel.

The pieces are then sewn together using three-thread overlock stitching. (This overlock stitching is also applied at the top center edge—collar area—of the back piece.) The front left side panel is sewn along its left edge to the left side edge of the back portion and its corresponding back sleeve portion, including mitt piece. The front right side panel is sewn along its right edge to the right edge of the back portion and its corresponding back sleeve portion, including mitt piece. The front left and right side panels are sewn along their bottom edges to the bottom edge of the back portion. The resulting infant sac has two front panels which overlap one another and can be opened or closed by their two fastening elements, and also, two sleeve ends which can be left opened or closed by folding over the mitt pieces.

OPERATION - FIGS. 8 AND 9

The manner of using the sac of this invention is simple. One lays the garment fiat with the panels fully open, then places the infant atop the back piece. From there, one easily slips the infant's arms and legs into the sleeves and sac, respectively. Beginning with the lower panel, one then proceeds to close each panel over the baby's body using the hook and loop fastener tabs at the opposite corners just below the armpit sections. If the separate leg compartments are desired, then one need simply part the legs under the closed garment and pull the hook and loop fastener tab up between the legs and attach it to its corresponding counterpart piece (FIG. 9). Again, this feature is possible because of the suppleness and ampleness of the garment. These also allow for considerable room for growth (about six month periods). Note that all three sets of hook and loop fastener tabs are positioned in such a manner as to not come into direct contact with the baby's skin. Essentially, the garment of this invention combines all the most practical components or features and also adds others to make for maximum comfort, convenience and usefulness.

Although the above description contains many specificities, these should not be construed as limiting the scope of the invention but as merely providing illustrations of some of the presently preferred embodiments of this invention. For example, the material used could be chosen to be of colors or prints to communicate (using stereotypes of course) the gender of the baby (e.g., pink vs. blue). Also, a simple matching hat could be made to complement the garment. Furthermore, the means of attachment need not necessarily be made of hook and loop fastener fasteners, although this seems to be the most comfortable and convenient option.

Thus the scope of the invention should be determined by the appended claims and their legal equivalents, rather than by the examples given.

I claim:

1. An infant sac comprising:

(a) a one piece T-shaped back portion including left and right sleeve portions each with sleeve ends, and a body portion having left, right and bottom edges;

(b) a one piece front right side portion including a right sleeve portion and left, right and bottom edges, attached along its right edge to the right edge of the back portion and its corresponding back sleeve portion;

(c) a one piece front left side portion including a left sleeve portion and left, right and bottom edges, attached along its left edge to the left side edge of the back portion and its corresponding back sleeve portion;

(d) the front left and right side portions overlapping and the back and front left and right portions attached together along their bottom edges;

(e) fasteners attaching said front left and right side portions together when overlapped and said sleeve ends having mitt pieces attached thereto so that the sac has closed sleeve ends or open sleeve ends as desired by folding the mitt pieces over during use.

* * * * *